United States Patent [19]

Nitzsche

[11] 4,081,773

[45] Mar. 28, 1978

[54] GROOVE RING FOR TOROIDAL-COIL DEFLECTION UNIT

[75] Inventor: Klaus Nitzsche, Straubing, Germany

[73] Assignee: International Standard Electric Corporation, New York, N.Y.

[21] Appl. No.: 676,782

[22] Filed: Apr. 14, 1976

[30] Foreign Application Priority Data

Apr. 16, 1975 Germany ..... 2516760

[51] Int. Cl.[2] ..... H01F 41/08

[52] U.S. Cl. ..... 335/213; 336/208

[58] Field of Search ..... 242/4 R, 4 B, 4 BE, 242/4 C; 335/210, 213; 336/15, 65, 83, 207, 208, 229

[56] References Cited

U.S. PATENT DOCUMENTS

| | | | |
|---|---|---|---|
| 3,601,731 | 8/1971 | Christiana et al. | 335/213 |
| 3,688,156 | 8/1972 | Utsunomiya et al. | 335/213 X |
| 3,859,719 | 1/1975 | Gostyn et al. | 242/4 R |
| 3,947,793 | 3/1976 | Thompson | 335/213 X |
| 3,980,242 | 9/1976 | Schmidt | 242/4 C |

*Primary Examiner*—A. D. Pellinen

*Attorney, Agent, or Firm*—John T. O'Halloran; Peter C. Van Der Sluys

[57] ABSTRACT

For the toroidal coils of the deflection units for color TV picture tubes, groove rings are used which serve to hold the wires of the toroidal coil in place and to advance the deflection unit during winding. A design of the ridges of these groove rings is described which is more rugged than the known design and thus permits the winding speed to be doubled without the ridges breaking out.

4 Claims, 9 Drawing Figures

GROOVE RING FOR TOROIDAL-COIL DEFLECTION UNIT

BACKGROUND OF THE INVENTION

The present invention relates to a groove ring for the deflection unit of a television set, which deflection unit consists of a toroidal coil surrounding a toroidal core, and which groove ring is provided with grooves formed by ridges at the outer circumferential surface of the ring and at one ring surface and serving to both receive and adjust the coil wires and guide the core while the toroidal coil is being wound thereon. FIG. 1 shows such a core with a toroidal coil. German Published Application No. 2,113,065 describes the winding of such toroidal coils with the aid of groove rings and discloses an apparatus therefor, which is shown in FIG. 2. The core is advanced during the winding operation by means of a gear which meshes with the grooves and turns the core forward and back as desired, with at least two contact rollers holding the ring in a freely rotatable position. Since, in such an arrangement, the ridges between the individual grooves have to be narrow so that the coil wires can be laid into the grooves, the applicant itself states in the above German Published Application that the grooves or the ridges forming the grooves are too weak for a gear drive, because the pressure forces are too high, so that the ridges will break out. To prevent this, German Published Application No. 2,325,002 teaches to set back every second group of grooves from the circumference of the ring at regular intervals in such a manner that the intermediate groups of grooves and ridges, which are not set back, form a gear rim suited for advancing the core during the winding operation. FIG. 3 shows such a groove ring with a driving pin wheel; it corresponds to FIG. 2 of the aforementioned German Published Application. Although such teeth of the gear ring no doubt result in a certain increase in strength, the possibility of the ridges breaking out cannot be excluded, particularly if relatively high windings speeds are used.

OBJECT, SOLUTION, AND ADVANTAGES

It is the object of the invention to modify a groove ring for a toroidal-coil deflecting unit so as to permit the core to be advanced even at high winding speeds by means of a gear meshing with the grooves at the outer circumferencial surface of the ring without any damage to the ridges of the groove ring, and, consequently, to the wire lying in the grooves. This object is attained by the means set forth in the claims. Already in the first experiments, the time needed to wind a deflection unit was reduced to one-half the time needed with a known design of the groove ring; thus, the rate of production could be doubled.

DESCRIPTION OF THE INVENTION

The invention will now be described in detail with reference to the accompanying drawings, in which.

Figure 1:
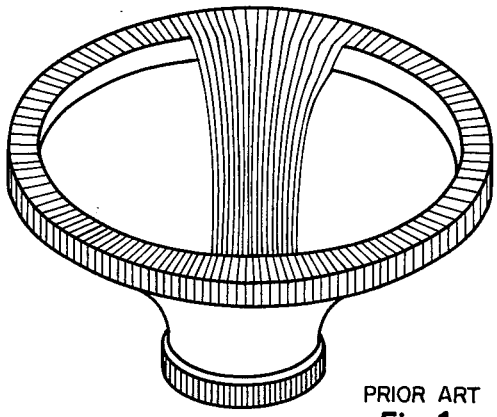
PRIOR ART Fig.1
FIGS. 1 to 3 show the above referred to examples of the prior art disclosed in German Published Application Nos. 2,113,065 and 2,325,002.
Figure 2:
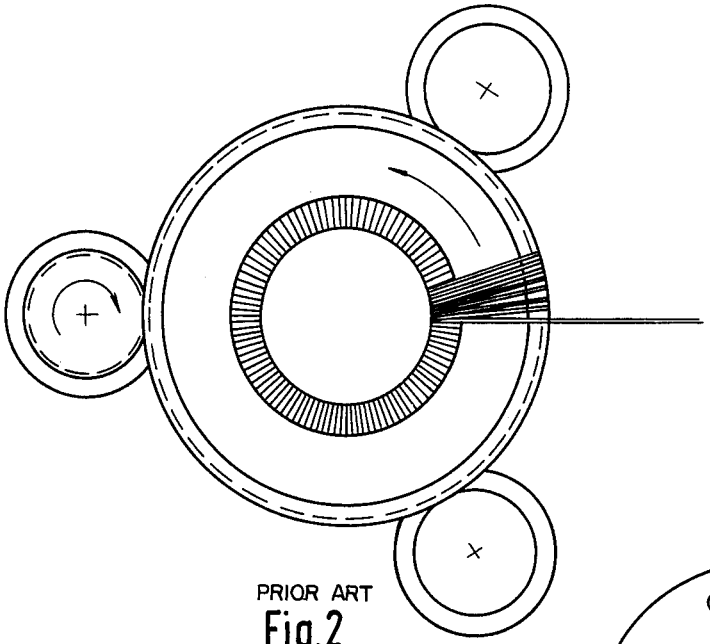
PRIOR ART Fig.2
Figure 3:
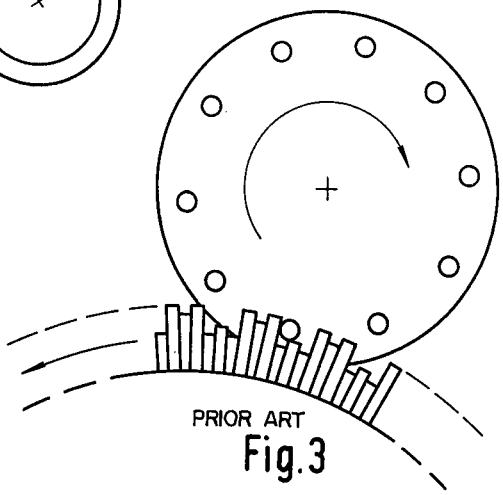
PRIOR ART Fig.3
Figure 4:
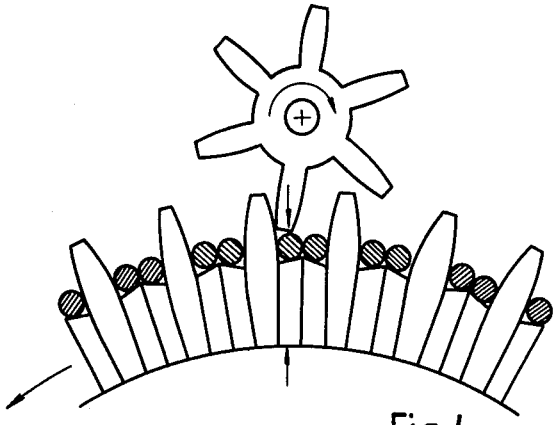
FIG. 4 is a top view of a segment of a groove ring according to the invention with two adjacent windings in a groove and with a meshing gear.
Figure 5:
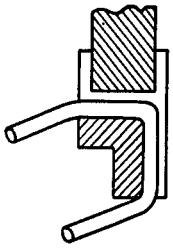
FIG. 5 shows a section through the groove ring of FIG. 4 and the driving gear.
Figure 6:
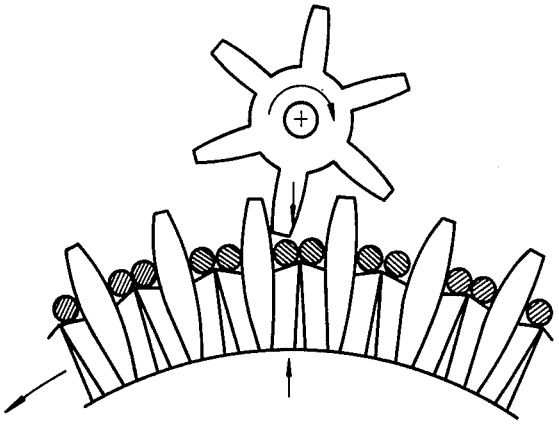
FIG. 6 is a top view of a modification of the groove ring of FIG. 4 with an intermediate ridge between two adjacent windings.

FIGS. 4 to 9 show segements and sectional views of groove rings in accordance with the invention. The figures are not to scale so that the essential features of the novel groove ring can be shown more clearly. The number of teeth of the gear shown is much smaller than that of the gear actually used in the winding machine. In the case of the groove ring shown in FIG. 4, two windings lie side by side in each groove. The space gained by the absence of the ridge between the two windings is used to reinforce the ridges on both sides of the two adjacent windings; the ridges can thus be made sufficiently wide and high to permit the gear to engage with the grooves, and the groove ring with the core to be advanced during the winding operation, without damage. In the figures, the coil wires are shown in section after reaching the bottom of the grooves of the ring surface. In reality, as can be seen from the sections of FIGS. 5, 8, and 9, they continue in the groove parallel to the ring surface and then, resting against the inner circumferential surface of the core, run to the other core opening, cf. FIG. 1. The groove arrangement of FIG. 4 has the disadvantage that there is an interspace between each pair of windings, caused by the width of the ridge, as a result of which the field distribution at the internal surface of the core is not quite optimal. This can be avoided if between the outer and the inner circumferential surface of the ring, separating ridges of increasing width are provided between the coil wires lying side by side in the groove, with the ridges and the additional separating ridges being equal in width at the inner circumferential surface of the ring so that the individual wires at the internal surface of the core are spaced equal distances apart. FIG. 6 shows such a groove ring arrangement.

Figure 8:
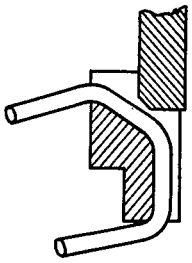
FIG. 8 shows a section through the groove ring of FIG. 7 with the driving gear.
Figure 7:
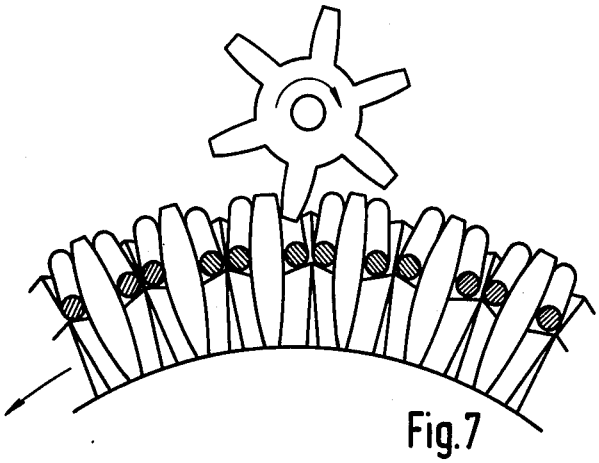
FIG. 7 is a top view of another modification in which the space for the engagement of the gear is obtained by chamfering the bottom of the groove at one edge.
Figure 9:
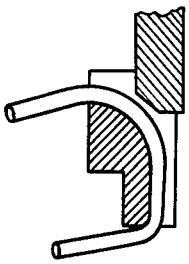
FIG. 9 shows a section through a modification of the groove ring of FIG. 7 in which the edge is not chamfered, but rounded.

A further increase in the mechanical strength of those portions of the ridges which mesh with the gear can be achieved by suitably chamfering the edge between the outer circumferential surface of the ring and the ring surface at the bottom of the groove to obtain ridges sufficiently high and wide to ensure the meshing of the gear, instead of having ridges projecting freely from the outer circumferential surface, in which case the force of the gear is applied over practically the entire width of the circumferential surface. FIG. 7 is a top view of a segment of such a groove ring, and FIG. 8 shows a section through this ring. Instead of being chamfered, this edge may also be rounded. FIG. 9 shows a section through such a groove ring. This arrangement has the advantage that the bending radius of th wire can be enlarged. In all modifications of the groove ring according to the invention, the ridges must, of course, be high enough to ensure that, when the gear is rolling over grooves already containing wires, the wire is not touched so that its insulation or even the wire core is not damaged.

What is claimed is:

1. A groove ring for the deflection unit of a television set, which deflection unit includes a toroidal wire coil surrounding a toroidal core, and which groove ring is provided with an inner circumferential surface comprising:

a plurality of first ridges located in spaced apart relationship on said inner circumferential surface, the width of said ridges decreasing towards said inner circumferential surface and the space between said ridges defining grooves;

a plurality of second ridges on said inner circumferential surface;

two of said second ridges being located in each of said grooves, said second ridges being of equal length, which length is less than said first ridges; and a third ridge formed between the two second ridges for separating wires in said groove.

2. The ring of claim 1, wherein the grooves of the ring receive two adjacent coil wires.

3. The ring of claim 1, wherein the ends of said second ridges are chamfered.

4. The groove ring of claim 1, wherein the ends of said second ridges are rounded.

* * * * *